United States Patent [19]

Hopper

[11] 3,984,334

[45] Oct. 5, 1976

[54] HIGH INTERNAL PHASE RATIO EMULSION FIRE EXTINGUISHING AGENT

[75] Inventor: Larry R. Hopper, St. Louis, Mo.

[73] Assignee: Petrolite Corporation, St. Louis, Mo.

[22] Filed: Feb. 28, 1974

[21] Appl. No.: 446,646

Related U.S. Application Data

[63] Continuation-in-part of Ser. No. 108,215, Jan. 20, 1971, abandoned.

[52] U.S. Cl. ..... 252/8.05; 252/8.1; 169/47

[51] Int. Cl.[2] ..... A62D 1/00

[58] Field of Search ..... 252/8.05, 2, 8, 309, 252/8.1; 117/136; 169/1 A

[56] References Cited

UNITED STATES PATENTS

| | | | |
|---|---|---|---|
| 2,182,440 | 12/1939 | Kotz et al. | 252/8.05 |
| 3,553,128 | 1/1971 | Wilson | 252/2 |
| 3,637,022 | 1/1972 | Kelly et al. | 252/2 |

*Primary Examiner*—Stephen J. Lechert, Jr.
*Attorney, Agent, or Firm*—Sidney B. Ring; Hyman F. Glass

[57] ABSTRACT

A thixotropic high internal phase ratio emulsion which is essentially nonflammable is employed as a fire extinguishing agent. In the preferred embodiment the emulsion contains an aqueous internal phase which makes up the major part of the emulsion, usually in excess of 90%, but preferably in excess of 95%, and a minor amount of an external phase which is of low volatility and/or flammability such as a heavy oil and an emulsifying material. Because it is thixotropic and cohesive, it forms a blanket over a fire, and coats adjacent surfaces, preventing the spread of the fire. This composition is particularly useful in fighting forest fires where the emulsion can be dropped or sprayed from aircraft with a minimum loss due to dispersion in air currents.

6 Claims, No Drawings

HIGH INTERNAL PHASE RATIO EMULSION FIRE EXTINGUISHING AGENT

This application is a continuation-in-part of Ser. No. 108,215 filed Jan. 20, 1971, now abandoned.

Currently, there are in existence many materials which are useful in fighting fires. Among these materials are carbon dioxide, ammonium sulfate, diammonium phosphate, dry powder, soda-acid, and water which is by far the most commonly used material in fighting an ordinary class A fire. Each of these materials are designed for fighting particular types of fire.

Fighting forest fires poses a difficult problem. Because most forest fires take place in remote areas, aircraft are often employed. Fighting forest fires with aircraft involves the dropping of huge quantities of water on the fire. However, by this method, as much as 80% of the load is wasted due to erosion before reaching the target. This means that the aircraft would have to make a considerable number of trips in order to get the required amount of water on the fire to cool the material below its ignition temperature.

Recently, a system was developed which reduced the erosion of the water to some 40% so that the useful load dropped by this system was increased thus making it up to three times as effective as a load dropped by a conventional system. This particular system involves the adding of a gelling agent or thickener to water, thickening the water so that when the material is dropped by the aircraft the frontal perimeter of the material is reduced. The addition of the thickening agent also causes the material to stick together rather than being torn apart by the air currents. However, even with the addition of this thickening agent, there is still approximately 40% wastage of the useful load.

I have now discovered that thixotropic high internal phase ratio emulsions can be employed as a fire extinguisher. In the preferred embodiment the emulsion contains an aqueous internal phase which makes up the major part of the emulsion, usually in excess of 90%, but preferably in excess of 95%, and a minor amount of an external phase which is of low volatility and/or flammability such as a heavy oil and an emulsifying material. Because it is thixotropic and cohesive, it forms a blanket over a fire. This composition is particularly useful in fighting forest fires where the emulsion can be dropped or sprayed from aircraft with a minimum loss due to dispersion in air currents. These emulsions are essentially non-flammable under the conditions employed.

Because of the inherent high viscosity of the high internal phase ratio emulsion, formulations may be produced which possess the desired viscosity properties without the incorporation of film-forming thickeners, or gelling agents.

Being hydrid solid-liquids, i.e. behaving as solids when at rest and as liquids when pumped, they possess the best properties of each. For example, it is possible to produce non-Newtonian emulsions which when sprayed on a fire can be readily pumped by conventional equipment but which regain their high viscosity almost instantly and therefore not only allow greater control of the spray pattern and reduced drift when sprayed by low flying aircraft but also greatly minimize the run-off after being applied to the fire area.

These non-Newtonian preparations are best exemplified by stable high internal phase ratio emulsions. High internal phase ratio emulsions possess radically different properties from those of the low or medium internal phase ratio types. Specifically, they are non-Newtonian in nature exhibiting a yield value phenomenon and a decrease in the effective viscosity with shear rate. In contrast to gels which require significant time periods to recover their body when subject to shear, high internal phase ratio emulsions recover to high viscosities almost instantaneously.

By "non-Newtonian" I mean a fluid of thixotropic or pseudo-plastic character. By definition, these fluids possess the property of exhibiting variable apparent viscosity when the shear rate is varied. Stated another way, when these fluids are pumped at low shear rates, they behave as though they are extremely viscous fluids; but as the pumping rate is increased and concomitantly the shear rate increases, the fluids appear to "shear thin" and then behave as though they have low viscosities.

I have particularly found, however, that the use of emulsions, and specifically high-internal-phase-ratio emulsions, i.e. where the internal phase is a major part of the emulsion, are particularly well suited for this purpose, since from an economic standpoint, large volumes of emulsion may be formulated with inexpensive major constitutents thereby providing inexpensive fluids.

The non-Newtonian fluids employed in the practice of this invention, however, are characterized by the fact that when at rest or under low shear conditions they behave like elastic solids or extremely viscous liquids; but when subjected to moderate shear rates, such as are encountered in pumping through pipes at practical, but not extremely rapid rates, the fluids behave as though they were low viscosity media. These emulsions contain an internal phase which is the major part of the emulsions; for example, at least about 60%, such as at least about 80%, but preferably in excess of about 90%, by volume, and often 95% or higher.

High internal phase emulsions of the type which can be employed in this invention are of the type disclosed in the following U.S. Pat. Nos. 3,352,109, 3,490,237, etc., provided the emulsions are essentially non-flammable.

The thixotropic emulsions of this invention, which have the characteristics of solids at rest and liquids when force is exerted on them, have the following advantages:

1. Yield Value — Yield values of 100 dy/cm$^2$ to more than 5,000 dy/cm$^2$ can be obtained. However, under low shear, they will flow with a viscosity approaching that of the liquid phases. On removal of shear, the recovery to original elastic solid form is nearly instantaneous. The hysteresis loop is very small.

2. Temperature Stability — Increased temperature has little effect on viscosity until the critical stability temperature is reached at which point the emulsion breaks into its liquid components. This permits a wide temperature range of use.

3. Shear Stability — Emulsions may be subjected repeatedly to shear without degradation so long as the critical shear point is not reached. At this point the emulsion breaks. However, the critical shear point is sufficiently high to permit high shear.

4. Quality Control — With these emulsions it is easy to reproduce batches with identical properties due to the absence of any "gel" structure.

5. Solids Content — Emulsions will flow well even with high solids content since they have a broad range between yield value and viscosity under modest shear.

Emulsions can be prepared by a continuous method, as described in U.S. Pat. No. 3,565,817. Thus, any of the essentially non-flammable oily and non-oily materials, emulsifiers and techniques, etc., described in the above applications can be employed in preparing the emulsions of this invention.

Since these emulsions have been described in such great detail in the above applications, repetition herein is unnecessary.

The following examples are presented for purposes of illustration and not of limitation.

EMULSIFIER A

An emulsifier was prepared by oxyalkylating 1,3-butanediol with 3.0 parts by weight of butylene oxide, 32.2 parts of propylene oxide and 16.6 parts of ethylene oxide in the order given.

EMULSIFIER B

An emulsifier was prepared by oxyalkylating triethyleneglycol with 5.1 parts by weight of butylene oxide, 30.0 parts of propylene oxide and 22 parts of ethylene oxide in the order given.

EMULSIFIER C

An emulsifier was prepared by oxyalkylating octyl phenol with 0.80 parts by weight of ethylene oxide.

In addition non-oxyalkylated emulsifiers can also be employed.

The following examples illustrate the preparation and use of fire fighting emulsions.

EXAMPLE I

An emulsion containing 97% by volume water as the internal phase and a solution of 80% kerosine and 20% by volume emulsifier C was made in a kitchen-type mixer such as the Kitchen Aid Mixer, model 3C manufactured by the Hobart Manufacturing Company. This mixer uses a 2 qt. glass mixing bowl and a wire beater with a planetary motion. Four, one liter, quantities of a high internal-phase ration emulsion were made by placing 30 ml of the kerosine/emulsifier C solution in the mixing bowl of the Kitchen Aid Mixer, setting the mixer at speed number 2, and adding 970 ml of water at a rate of 10 ml/min. The result was a thick, creamy, white, stable emulsion containing 97 volumes of water and 3 volumes of oily external phase. The 4, one liter, quantities were placed in a glass jar and taken to the test site which was a 12 ft. high bluff. The emulsion was taken to the top of the bluff and poured into a 5 gallon, open-top bucket. At the base of the bluff, branches of trees were stuck in the ground and crushed dry leaves placed on the ground around the branches to simulate a forest. The simulated forest covered an area of approximately 2 ft. square. The wood and leaves were then ignited and the flames allowed to reach a height of approximately 2 feet. While the fire was increasing in intensity, a lid was placed over the bucket containing the emulsion, the bucket inverted and positioned over the fire. The lid was quickly removed and the emulsion allowed to fall directly on the fire, which was instantaneously extinguished. The wood and leaves were completely blanketed.

EXAMPLE II

A ¾ inch Jabsco, positive displacement pump, driven by a ¾ horsepower electric motor, was equipped with a 5 ft. plastic hose on the discharge side and the same type of hose connected to a "Tee" on the suction side. Another length of hose was attached to the "Tee" perpendicular to the direction of flow through the pump, and placed in a 55 gallon drum containing a solution of 38.5 gallons of water and 9 gallons 10–34–0, liquid fertilizer. The ends of the other two hoses were placed in a 55 gallon open-head, steel drum containing 2.5 gallons of a solution of 20% by volume emulsifier C and 80% kerosine colored with a minute quantity of an oil-soluble red dye. With this arrangement, the dyed solution of kerosine and emulsifier C could be pumped out of the drum, through the pump, and back into the drum while slowly mixing in the solution of water and 10–34–0 liquid fertilizer. After approximately 20 minutes of mixing all of the aqueous solution was added resulting in a thick, stable, light red emulsion with an oily external film. One hundred and fifty gallons of emulsion were made by this method. Seventy-Five gallons of the emulsion was loaded into one of the pontoons of a single-engine pontoon-equipped, aircraft using the Jabsco pump. The remaining 75 gallons of emulsion was loaded into the other pontoon. The aircraft then took off, without any difficulty, and flew to a designated area for dropping the emulsion. The first 75 gallons of emulsion were dropped at an altitude of approximately 100 feet at an aircraft speed of 80 knots and in a cross-wind of approximately 20 knots. The emulsion broke up into very thick droplets and landed in a partially foliated area. The emulsion displayed good adherence to the tree leaves and blades of grass covering an area of approximately 20 sq. ft. The other 75 gallons of emulsion was dropped under the same conditions as the first except that it was dropped in a completely foliated area. The same pattern was achieved in this area. Also there was some adherence of the emulsion to the trunks and branches of the trees.

EXAMPLE III

A ¾ inch Jabsco, positive displacement pump, driven by a ¾ horsepower electric motor was equipped with a 5 ft. plastic hose on the discharge side and the same type of hose connected to a "Tee" on the suction side. Another length of hose was attached to the "Tee" perpendicular to the direction of flow through the pump and placed in a 55 gallon drum containing a solution of 38.5 gallons of water and 9 gallons of a very impure, 10–34–0 liquid fertilizer. The ends of the other two hoses were placed in a 55 gallon open-head steel drum containing 2.5 gallons of a solution of 20% volume emulsifier C and 80% kerosine. With this arrangement, the solution of kerosine and emulsifier C, could be pumped out of the drum, through the pump, and back into the drum while slowly mixing in the solution of water and 10–34–0 liquid fertilizer. In about 20 minutes the aqueous solution was added resulting in a thick, stable, light gray emulsion with an oil external film. Six hundred gallons of the emulsion were prepared by this method. Three hundred gallons of the emulsion was loaded into the left half of the divided tank of an airplane designed to apply liquid or slurried materials. The other three hundred gallons was loaded in the right side of the tank. The tank was equally divided with two "flapper-type" valves in the center to allow the material to level out. The aircraft took off without any difficulty, made two practice runs on the target area and then on its third run, dropped the emulsion from an altitude of 200 feet, at a speed of 125 knots. At the time of the drop, there was practically no wind. The drop came nearly straight down and its impact with the ground could be easily heard. The coverage was estimated to be approximately ¾ acre which was comparable to other materials of this type. The top half of the simulated branches were completely blanketed. There was no indication of any coverage on the bottom. The distribution of the emulsion appeared to be uniform throughout the coverage area and did not appear to be slippery to any great extent. Near the edges of the impact area, the emulsion showed somewhat of a "polka dot" effect contacting the ground in very large droplets.

The results achieved in the above tests indicated that such emulsions would be very effective in extinguishing forest fires. When dropped, the emulsion tends to stick together in a mass rather than being torn apart by air currents. Also, by having the less volatile material in the external phase, the water load and/or fire retardant being dropped is surrounded by a material which is relatively unaffected by evaporation when dropped through the air, thus assuring that the maximum amount of water and/or fire retardant would reach the surface and contact the fire. In addition to the ability of the emulsified material to reduce erosion of the load it is also relatively non-corrosive, because of its hydrocarbon external coat. It can be made to contain a pesticide in the hydrocarbon external phase; it can also contain a fire retardant material in the internal or external phase and it can also contain a liquid fertilizer. Thus, when the material was dropped as a fire bombing agent it would degrade into its components; the water would then extinguish the fire, the liquid fertilizer would act as a fertilizer material for the surrounding plants, the pesticides would serve to control insects and the fire retardant material would further insure that the water was effective in extinguishing the fire. The further advantage of this emulsion is that the emulsifying agent used is relatively biodegradable, not being persistent or harmful to wild life.

Fire fighting is based on the concept that a fire is controlled by:

1. Removing the fuel
2. Excluding oxygen
3. Lowering the temperature of the fuel.

In combatting fire, the fire fighters usually start by soaking down the surrounding terrain and structures so as to maintain them below the combustion temperature and thereby restrict the spread of the fire. Various streams and materials are then directed onto the fire itself to either exclude oxygen or lower the temperature or both. In actual practice, most fires are fought primarily by the use of water and most of the water consumed in fighting a fire is used in preventing the spread of the fire to adjacent areas.

In combatting forest fires, water, or aqueous solutions containing fire retardants, are air dropped on the forest just ahead of the fire so as to slow the fire and direct it to where it can be successfully fought by ground forces. It is well known that the incorporation of thickening or gelling agents into the fire retardant formulations improves their drop pattern and increases their ability to coat and protect foliage.

I have discovered that high internal phase ratio emulsions have very unexpected properties in regard to fighting fires, for example, as compared to water itself or gels, particularly as to their resistance to destruction by radiant heat. The protection of the emulsion against radiant heat, even without fire retardant, is unexpected, particularly when compared to water gels without retardant.

The following are presented as non-limiting examples.

EXAMPLE A

Small aluminum weighing dishes approximately 5 cm in diameter and 1 cm deep were used as containers for the test. 100 grams each of water retardant solution, gelled water, gelled retardant solution, emulsified water and emulsified retardant solution were used in the tests. The weighing dishes were placed on a fire retardant surface and a battery of heat lamps so arranged to provide a uniform heat flux were placed above the dishes, and the dishes subjected to a radiant heat flux simulating that provided by a proximal fire.

At various intervals of time, the dishes were removed, weighed and returned to the set-up. The values of weight loss versus time are shown in Table I. It will be seen that the water or retardant solution evaporates at a certain characteristic rate, that the gelled materials evaporate at essentially the same rate as the unthickened material, but that the emulsion unexpectedly evaporates at a much slower rate. This means that a layer of emulsion spread on a surface will persist for a significantly longer time than unthickened retardant, water, or gel under high radiant heat flux conditions, and will therefore maintain the surface below the ignition temperature for significantly longer periods than either water retardant or formulations thickened by other means.

Table I

| | Retardant Present | % Wt. Loss After | | | | | |
|---|---|---|---|---|---|---|---|
| | | ½ Hr. | 1 Hr. | 1½ Hrs. | 2 Hrs. | 4 Hrs. | 6 Hrs. |
| A | Yes | 29.7 | 67.9 | 73.1 | 77.3 | 80.3 | 80.4 |
| B | Yes | 30.3 | 69.3 | 77.6 | 78.2 | 82.0 | 82.3 |
| C | Yes | 3.9 | 23.3 | 39.0 | 53.6 | 74.3 | 82.6 |
| D | Yes | 11.6 | 46.3 | 80.2 | 81.8 | 82.9 | 83.8 |
| E | No | 42.3 | 98.9 | — | — | — | — |
| H | No | 37.9 | 62.3 | 82.3 | — | — | — |
| K | No | 65.3 | 99.9 | — | — | — | — |

A - Fire retardant solution + 1% gelling agent.
B - Fire retardant solution + 0.5% gelling agent.
C - Fire retardant solution emulsion w/o, 95/5, made with oxyalkylated nonionic emulsifier.
D - Fire retardant solution unthickened.
E - Water + 0.5% gelling agent.
H - Water emulsion w/o, 95/5, made with oxyalkylated phenol emulsifier.
K - Water as is.

EXAMPLE B

A fire management program to improve protection of a large foothill area was initiated.

This resulted from months of planning, with input from botanists, fire departments, citizens, state and federal fire control personnel and fire control research workers. The initial phase was determined to be replacement of fire breaks with a fuel break system, up to 400 feet wide, in which natural vegetation is permanently modified by clearing and replanting with fire resistive, low fuel plants so that fire burning into it can be more readily controlled.

The 95/5 w/o emulsion of this invention emulsified with an oxyalkylated nonionic successfully stopped a test fire in chaparral brush. A strip 5 feet wide, 300 feet long, 6 to 9 feet high on a 35° slope was belted at 150-foot intervals by 8-foot wide swaths of the new emulsion and at 250 feet with a standard air drop retardant of the same width. Fire was set at the downwind end of the windraw so that the wind would drive the fire. The fire was completely stopped on contact with the emulsion containing no retardant with no base burn-through. Smoldering continued for over one hour without any flareups. The standard liquid retardant formulation was almost as effective in fire stop except that some burn-through was experienced at about the half-hour point after contact.

The major differences between the water emulsion and existing thickened retardants are ecological, equipment maintenance and structural protection benefits. The emulsion is totally biodegradable, nontoxic, less corrosive than water, nonsterilant and retains a high radiation heat barrier for up to 24 hours.

EXAMPLE C

Municipal Fire Fighting — Structures

As a result of successful tests with the emulsion in pre-treatment of brush in advance of fires, two additional areas were investigated. The first was to determine that the potential of emulsion application by fire pumpers; simple plumbing modification to existing pumpers permit its use. The second area developed from tests of the emulsion's potential to adhere to vertical surfaces and provide a radiation heat barrier for potential use on structures as usually occurs in municipal fires (buildings, etc.) as contrasted to forest or brush fires.

An all-wood structure was moved to a site area for evaluation. The demonstration involved placing a U-shaped windraw of heavy dry chapparal brush eight feet wide by five feet high, five feet away from three sides of the structure. Using premixed emulsion in the tank of a pumper, an application was sprayed by nozzle on two windward sides and on one-half of the pitched roof. Approximately 180 gallons were used to coat these areas with emulsion. The brush was ignited instantaneously for its full length to accelerate heat buildup. Time lapse photos were set up to determine the degree of radiant heat; normally a fire of this intensity engulfs a wooden structure. The success of this test was such that the brush burned down to ash but the building remained intact except for the window breaking out.

To check the validity of the test, the structure was ignited from the interior. Treated portions burned totally from within as the emulsion held off all exterior ignition until destruction was virtually total — proving the building was burnable while the emulsion was effective to the end of the test.

The success of these tests leads to new areas of wildland fire fighting and of structural or municipal fire fighting. In wildland fires the use of emulsified retardant by pumper/tankers to enhance air drops and pretreatment of structures in the path of fire adds two more links in closing the fire suppression circle. A side effect appears to be in improving manpower and equipment utilization by requiring less of each to protect structures, since once the emulsion is applied, fire fighters can proceed to another problem.

In summary, the present invention forms an emulsion which is non-toxic to man, animals, or plants. It is effective in putting out or preventing the spread of fire in both forest and related fires as well as municipal or structural fires. It has extremely good radiation resistance, surprisingly so even where no fire retardant is used in the emulsion.

EXAMPLE D

The fire fighting emulsion of this invention can also be employed in a home, office, institutional, factory, automobile, boating, aircraft, etc., emergency fire fighting apparatus. For example, a 95/5 w/o emulsion is stored in a plastic container. By squeezing the plastic container through a nozzle and directing the stream of the emulsion on or near the fire, the fire is put out or its spreading is controlled.

Automatic devices can also be employed in place of hand squeezing to facilitate the spread of the emulsion. Thus, as a safety measure, any container of the emulsion can be kept on hand in any place where fire is a possibility, and sprayed upon or in the vicinity of a fire by hand pressure or by any automatic or semi-automatic means of spreading the emulsion.

As is quite evident, a wide variety of thixotropic emulsions are useful in this invention. It is, therefore, not only impossible to attempt a comprehensive catalogue of such compositions, but to attempt to describe the invention in its broadest aspects in terms of specific chemical names for the components of such emulsions would be too voluminous and unnecessary since one skilled in the art could by following the description of the invention herein prepare an appropriate emulsion. This invention encompasses the use of thixotropic and other pseudo plastic fluids in fire fighting formulations and the individual components of such fluids are important only in the sense that they affect this function. To precisely define each specific useful phase of the emulsion and emulsifier in light of the present disclosure would merely call for chemical knowledge within the skill of the art in a manner analogous to a mechanical engineer who prescribes in the construction of a machine the proper materials and the proper dimensions thereof. From the description in this specification and with the knowledge of a chemist, one will know or deduce with confidence the applicability of specific phases of the emulsions and emulsifiers suitable for this invention by applying them in the process set forth herein. In analogy to the case of a machine, wherein the use of certain materials of construction or dimensions of parts would lead to no practical useful result, various materials will be rejected as inapplicable where others would be operative. I can obviously assume that no one will wish to use a useless emulsion nor will be misled because it is possible to misapply the teachings of the present disclosure to do so. Thus, any thixotropic emulsion that can perform the function stated herein can be employed.

I claim:

1. A method of fighting fires which comprises applying an essentially nonflammable thixotropic high internal phase ratio water-in-oil emulsion to the fire or to the materials in the path of a fire, said emulsion having the characteristics of an elastic solid when at rest, of an extremely viscous liquid at low shear conditions and of a low viscosity medium under moderate shear rates, said emulsion being highly resistant to destruction by radiant heat, said emulsion comprising water, an emulsifiable oil and a biodegradable oxyalkylated emulsifying agent not persistent and harmful to wild life, said water being present in said emulsion in an amount of at least 60% by volume of the emulsion.

2. The process of claim 1 where said water is present in an amount of at least 90% water by volume of the emulsion.

3. The process of claim 2 where the emulsion includes a fire retardant.

4. The process of claim 1 where the emulsifying agent is an oxyalkylated hydroxy compound.

5. The process of claim 4 where the oxyalkylated hydroxy compound is prepared by oxyalkylating 1,3-butanediol with butylene oxide, propylene oxide and ethylene oxide in the order given.

6. The process of claim 1 where the emulsifiable oil is kerosine.

* * * * *